US006369768B1

(12) United States Patent
Fusinski

(10) Patent No.: US 6,369,768 B1
(45) Date of Patent: Apr. 9, 2002

(54) AUTOMOTIVE ON GLASS ANTENNA WITH PARALLEL TUNED FEEDER

(75) Inventor: Richard E. Fusinski, Clinton Township, Macomb County, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/759,673

(22) Filed: Jan. 16, 2001

(51) Int. Cl.[7] ..... H01Q 1/32
(52) U.S. Cl. ..... 343/713; 343/704
(58) Field of Search ..... 343/704, 711, 343/713, 793, 795; H01Q 1/32

(56) References Cited

U.S. PATENT DOCUMENTS

| | | | | | |
|---|---|---|---|---|---|
| 4,746,925 A | | 5/1988 | Toriyama | 343/713 |
| 5,027,128 A | * | 6/1991 | Blaese | 343/713 |
| 5,198,826 A | | 3/1993 | Ito | 343/726 |
| 5,497,167 A | | 3/1996 | Luoma | 343/828 |
| 5,650,791 A | * | 7/1997 | Talty | 343/713 |
| 5,923,298 A | * | 7/1999 | Miyahara et al. | 343/713 |
| 6,018,324 A | * | 1/2000 | Kitchener | 343/795 |
| 6,031,500 A | | 2/2000 | Nagy et al. | 343/713 |
| 6,211,831 B1 | * | 4/2001 | Nagy et al. | 343/713 |
| 6,300,912 B1 | * | 10/2001 | Pla | 343/713 |

* cited by examiner

*Primary Examiner*—Tho Phan
(74) *Attorney, Agent, or Firm*—Laura C. Hargitt

(57) ABSTRACT

A glass antenna assembly for receiving and transmitting cellular telephone signals includes a two pair of dipole antennas, each pair mounted on a vehicle window. Space diversity is achieved by placing the vehicle windows with the antenna pair on opposite sides of the vehicle. This results in an improved omni-directional antenna pattern. Each dipole antenna is tunes, and employs at least three elements to broad band the dipole antenna. Coaxial feeders leading from the antenna assembly can be concealed under the roof lining for improved aesthetics.

15 Claims, 6 Drawing Sheets

AUTOMOTIVE ON GLASS ANTENNA WITH PARALLEL TUNED FEEDER

FIELD OF THE INVENTION

This invention relates generally to an antenna apparatus, system and method for receiving and transmitting cellular telephone signals. More particularly, the invention relates to a dipole antenna coupled to a transmission line that is printed on a vehicle window.

BACKGROUND

A number of apparatus and methods exist for an antenna that utilizes the surface of a glass. For example, one type of antenna has been used exclusively for reception in the VHF band, having a low gain and an unfavorably high voltage standing wave ratio (VSWR). For practical reasons, pole or rod antennas have been used for portable communications services such as cellular telephones and for receiving global positioning satellite (GPS) signals.

Rod and pole antenna typically extend outward from the automobile, and generally create noise at high speed, interfere with washing of the vehicle, can be snagged on low branches, and adversely affect the overall aesthetics of the vehicle.

Dipole antennas typically appear as a metal rectangle on the end of a short mounting beam, and is the basic antenna for fixed point communications. Dipole antennas are omni-directional when vertically polarized and have relatively low gain. It is not common to use a dipole antenna in a horizontally polarized system because other antennas having higher gain and lower cost are readily available.

As depicted in FIG. 1, shielded dipole antennas 10 are also known, for example, U.S. Pat. No. 4,746,925. The coaxial cable 12 must run across a window glass 14, which is aesthetically unappealing and obscures driver or passenger visibility. Moving the antenna 10 closer to pillars or trim area 16 degrade performance as the dipole radiation pattern is severely distorted by the proximity of the surrounding metal, as well as significantly radiating into the vehicle.

Consequently, there is a need for a dipole antenna that provides improved antenna performance and as well as improved aesthetic qualities.

SUMMARY OF THE INVENTION

Accordingly, it is a primary object of the present invention to provide an antenna system for the reception of cellular telephone signals and transmission of the cellular telephone signals to a cellular receiver, as well as the transmission of cellular signals from a cellular transmitter to external cellular receivers over a transmission line having an improved omni-directional antenna pattern when mounted on a vehicle window.

Another object of the invention is to provide a dipole antenna mounted on the surface of a vehicle window that is in a clear path RF environment.

Another object of the invention utilizes two sets of dipole antennas with a modified feed length, each antenna positioned on opposite sides of the vehicle providing enhancement of the radiation pattern.

The present invention is directed to an automotive on glass antenna having parallel tuned feeders. Two sets of antenna elements are printed on a vehicle window and are tuned to an upper part of the desired frequency band and to a lower part of the desired frequency band. The antenna elements can be printed on the glass using techniques known in the art for printing rear defogger elements and AM/FM radio antennas onto glass. For example, in a cellular telephone application having a bandwidth of approximately 70 MHz, a VSWR of less than 2:1 can be maintained. Each tuned dipole antenna employs three elements to broad band the dipole antenna. A parallel tuned feeder for each antenna is a multiple electrical half wavelength to transfer the approximately 50 Ohm impedance of the dipole. Parallel tuned feeders transform the impedance of the coaxial cable to match the impedance of the antenna. The parallel tuned feeder allows for the placement of the printed modified dipole antenna in a clear path RF environment, resulting in a well-defined omni-directional antenna pattern.

The printed antenna elements are connected to one end of a coaxial cable, which forms a coaxial transmission line. This coaxial transmission line has an impedance of approximately 75 Ohms and odd multiple electrical quarter wavelengths. One hundred-ohm transmission line combines in parallel to 50 ohms, feeding into a 50-ohm transmission line matching the impedance of the transmitter. This results in the power supplied at the feed point to be split and each antenna receives one-half of the input power.

A relatively symmetrical radiation pattern is achieved by placing one of these dipoles on each side window of a vehicle having stationary window glass, resulting in space diversity. Additionally, by splitting the power equally between the antennas, the field strength is also divided, and the amount of RF exposure to the interior of the vehicle is reduced.

One advantage of using two dipoles with space diversity is an improved radiation pattern versus a single dipole pattern.

Use of window mount dipole antenna of this invention virtually eliminate rain leakage, are less costly that roof installed antennae, improves vehicle appearance, and can be utilized on all vehicles having a stationary or partially stationary window. Vehicle appearance is also improved by concealing the coaxial transmission line going to the transmitter, for example, beneath the roof liner.

These and other features and advantages of this invention are described in or are apparent from the following detailed description of the preferred embodiments.

BRIEF DESCRIPTION OF THE DRAWINGS

The preferred embodiments of this invention will be described in detail, with reference to the following figures, wherein.

Throughout the drawing figures, like reference numerals will be understood to refer to like parts and components.

DETAILED DESCRIPTION OF THE PREFERRED EMBODIMENT

Figure 1:
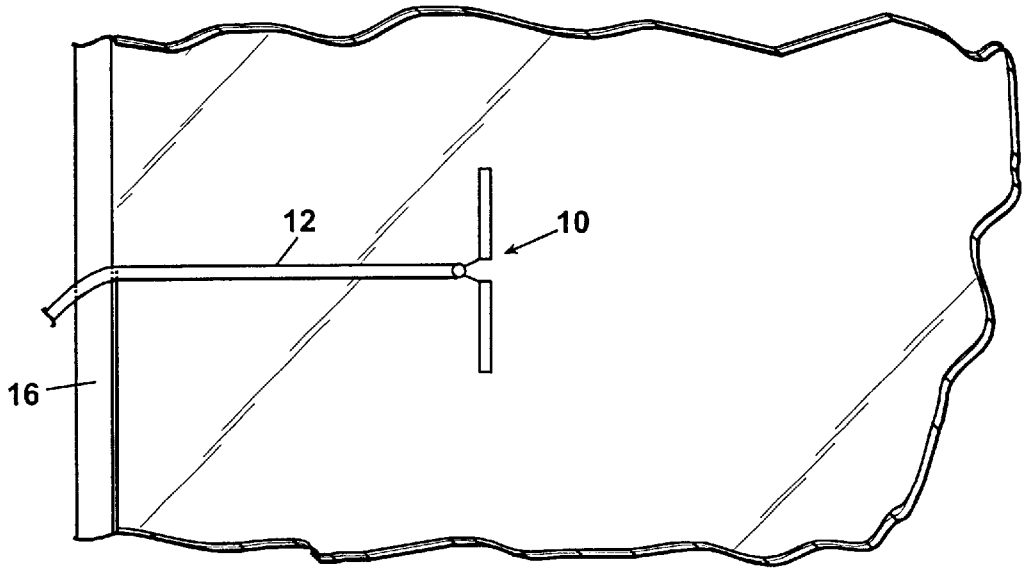
Fig. 1 (Prior Art)
FIG. 1 is a planar view of a single dipole antenna of the prior art.
Figure 2:
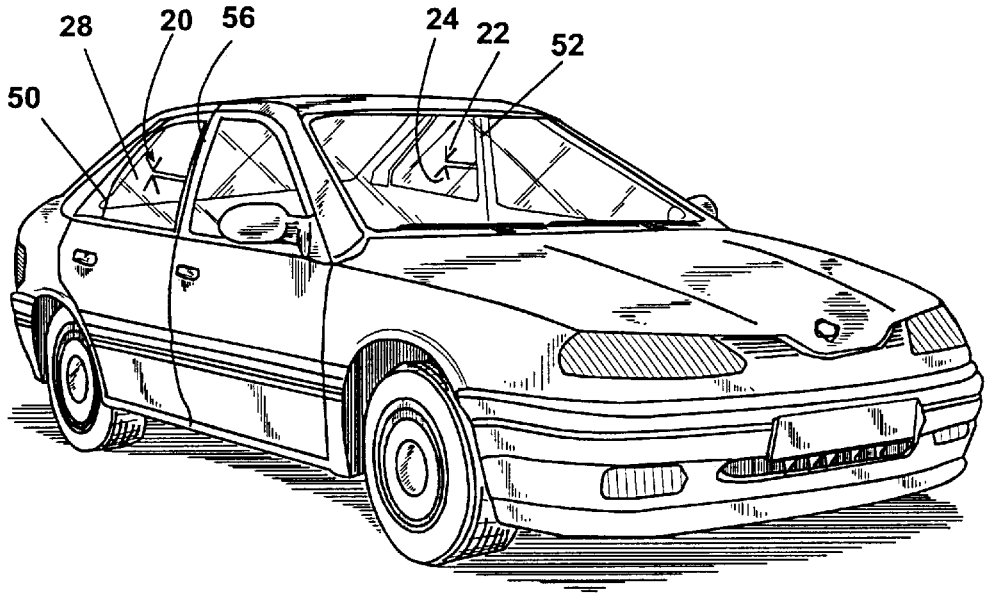
FIG. 2 is a perspective view of a dipole antenna of the invention on a side window of a vehicle.
Figure 3:
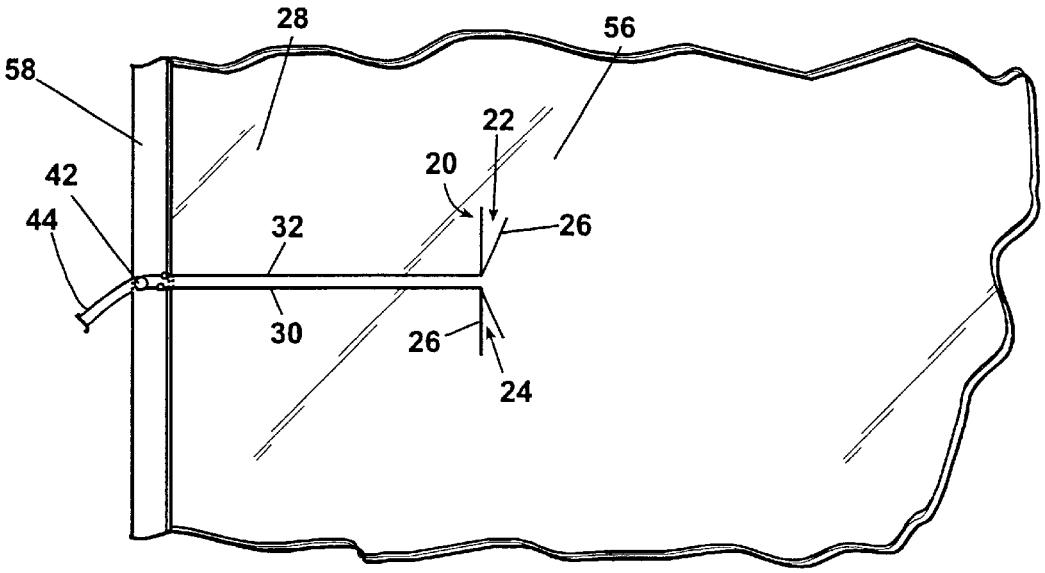
FIG. 3 is a close-up planar view from the outside of the vehicle of the antenna shown in FIG. 2 attached to the window.
Figure 4:
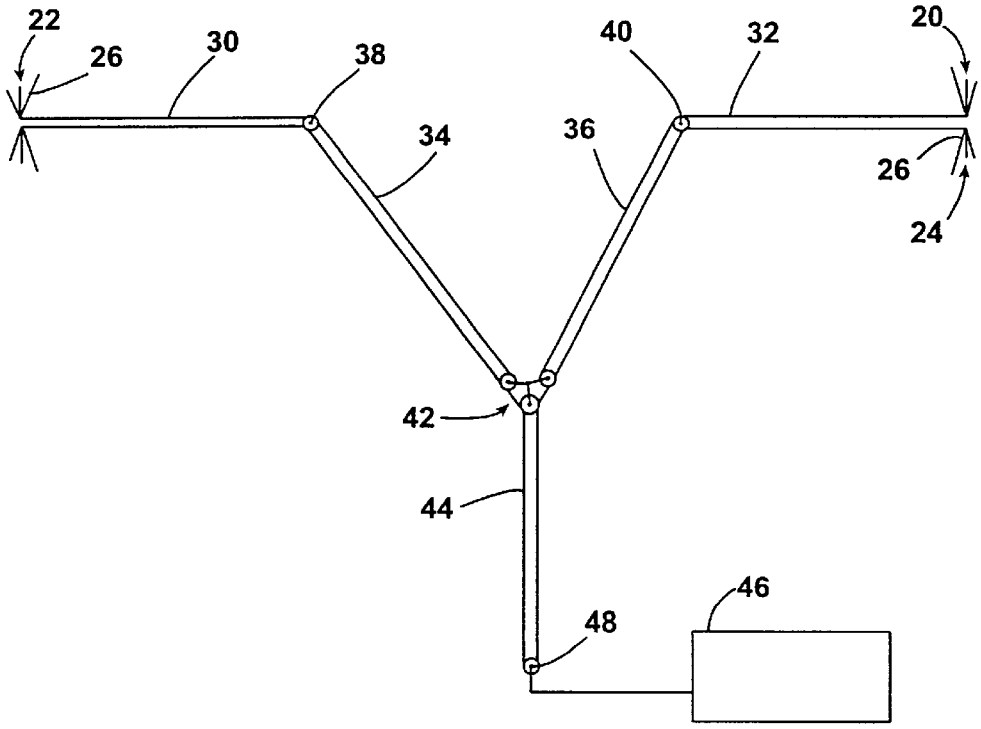
FIG. 4 is a diagram depicting a passive diversity antenna system with parallel tuned feeders of the invention.

As seen if FIGS. 2–4, which depict various details of the antenna assembly 20 of this invention, the antenna assembly 20 has two tuned dipole antenna 22, 24, each antenna 22, 24 having at least two wires 26 mounted on a vehicle window 28, and a parallel tuned feeder 30, 32 electrically connected at a first end to each of the antenna 22, 24. Each parallel tuned feeder 30, 32 is electrically connected at a second end to a coaxial cable 34, 36 at combining points 38, 40. Both coaxial cables 34, 36 are combined together at a combining point 42, where another coaxial cable 44 electrically connects the two tuned dipole antenna 22, 24 to a transceiver 46.

In the preferred embodiment, the dipole antenna 22, 24 utilize three antenna wires, or elements 26 to broad band the dipole antenna. This method of broad banding is also known in the art as diversity feed, and two or mores wires are typically used to broad band. In FIG. 3, the two sets of antenna elements 26 are tuned for the upper and lower part of the desired frequency band. For a cellular telephone, when the bandwidth is 70 MHz, a VSWR of less than 2:1 can be maintained.

The antenna 22, 24 are preferably omni-directional in an elevation plane between 0 degrees and 60 degrees from the horizontal. The voltage standing wave ratio, VSWR, preferably has a value of 2 or less, where 1 is a perfect 50 ohm antenna.

Parallel tuned feeders 30, 32 are multiple electrical half wavelengths used to transfer the 50 Ohm impedance of the dipole at the combining points 38, 40.

The dipole antennas 22, 24 and the parallel tuned feeders 30, 32 are preferably printed on the vehicle window 28 using existing technology, for example, printing automobile rear defogger elements and AM/FM radio antennas on glass.

Coaxial transmission lines 34, 36 have an impedance of 75 Ohms each and are odd multiple electrical quarter wavelengths. The coaxial transmission lines 34, 36 combine at the combining point 42 at 100 ohms each, combining in parallel to 50 ohms. The parallel tuned feeders 30, 32 transforms the impedance of the coaxial cables 34, 36 to match the impedance of the antenna.

The coaxial transmission line 44, located inside the vehicle 54, is connected to a transceiver 46, transferring the RF signals to the transceiver 46 for conversion to audio. The coaxial transmission line 44 is 50 ohms to match the impedance of the transceiver 46. In this manner, the power supplied at the transceiver feed point 48 is split at the combining point 42 and each dipole antenna 22, 24 receives one-half of the power input.

The transceiver 46 can be any radio frequency transceiver. In the preferred embodiment, the transceiver 46 is a cellular telephone, either analog, digital, or PCS, using any frequency assigned for the service. In the preferred embodiment, the transceiver 46 is a cellular telephone operating in the frequency range of approximately 820 to 900 MHz.

In this manner, a relatively symmetrical radiation pattern is achieved by placing one of the dipole antennas 22, 24 on each side window 50, 52 of a vehicle 54 where the glass on the side windows 50, 52 is stationary. Additionally, since the power is split equally, the field strength at each antenna 22, 24 is also divided.

On the reciprocal, the received signal can be added or subtracted at the combining point 42. A total received signal of plus or minus 3 dB over a single dipole antenna 22, 24 is possible, due to the combinations of instantaneous phase relationship at the antennas 22, 24. This equates to an amount equal to or slightly less than the received signal at the transceiver 46 when compared to a traditional roof mount antenna.

The use of two dipole antennas 22, 24 have the advantage of seeing both sides of the vehicle without obstruction versus a single dipole antenna on one side window. This is also known as space diversity.

As depicted in FIGS. 2 and 3, the antennas 22, 24 are attached to the vehicle side windows 50, 52 near the center of the viewing area 56. This effectively places the antennas 22, 24 farthest away from any metal that can interfere with the operation of the antennas 22, 24, such as door trim 56. The coaxial cables 34, 36, 44 are located beneath the headliner, not shown, for improved vehicle aesthetics.

Alternatively, the coaxial cables 34, 36, 44 can be concealed beneath any interior panel, carpet, trim, and the like to effectively conceal and route the cables to the transmitter.

FIGS. 5 to 12 show antenna patterns and average gain plots for a collinear antenna mounted on a vehicle known in the art. FIGS. 13–20 show antenna patterns and average gain plots for a dipole antenna of the present invention. The reported angle is with respect to the horizon, but referenced to the bottom of each antenna. Measurements were taken at 0 degrees, 20 degrees, 30 degrees and 40 degrees. All measurements were taken with vertical polarization.

Antenna gain is a measure of how well the antenna will send or receive an RF signal. Gain is typically measured in decibels-isotropic, dBi, or in decibels-dipole, dBd. When using dBi, performance is a determination of how much better the antenna is compared to an isotropic radiator. An isotropic radiator is an antenna that sends signals equally in all directions. A true isotropic antenna has a 0 dBi gain. The higher the decibel figure, the higher the gain. For example, an antenna having a 6 dBi gain will receive a signal better than a 3 dBi antenna. Dipole antennas typically have a 2.4 dBi gain as dipole antennas are better than isotropic radiators. Additionally, dipole antennas are omni-directional when vertically polarized.

The average gain for each antenna at each elevation angle is given as average gain and linear average gain. The average gain is determined as the average measured gain. The linear average gain is determined by taking the average gain values in dBi, converting those values to linear equivalent, averaging the linear values, and converting back to dBi. When the antenna pattern is perfectly symmetrical, the average gain and the linear average gain will be identical. When the antenna pattern is not symmetrical, the linear average gain will always be higher than the average gain. This in a result of the average gain not being indicative of the actual power under the curve.

Figure 5:
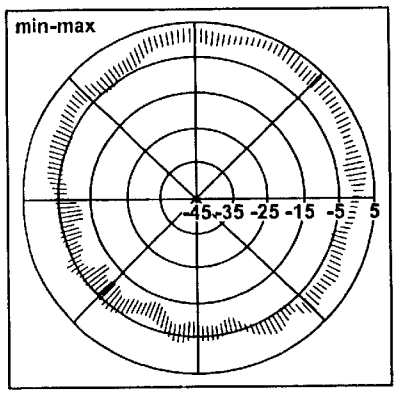
Fig. 5 (PRIOR ART)
FIG. 5 depicts the min-max horizontal directional diagram of a prior art collinear antenna taken at 0 degrees with respect to the bottom of the antenna.
Figure 6:
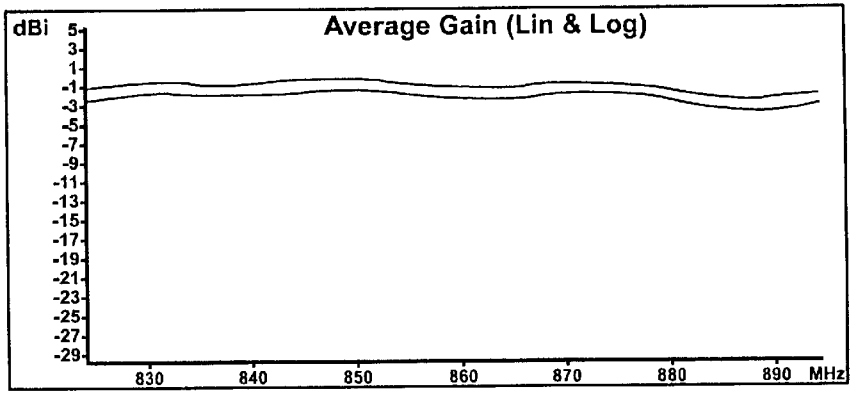
Fig. 6 (PRIOR ART)
FIG. 6 depicts the average gain of a prior art collinear antenna taken at 0 degrees with respect to the bottom of the antenna.
Figure 7:
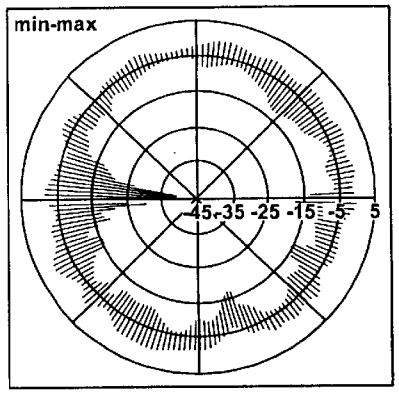
Fig. 7 (PRIOR ART)
FIG. 7 depicts the min-max horizontal directional diagram of a prior art collinear antenna taken at 20 degrees with respect to the bottom of the antenna.
Figure 8:
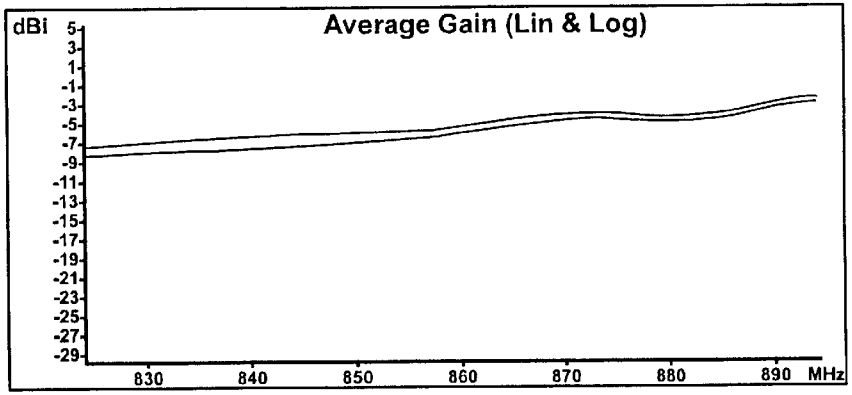
Fig. 8 (PRIOR ART)
FIG. 8 depicts the average gain of a prior art collinear antenna taken at 20 degrees with respect to the bottom of the antenna.
Figure 10:
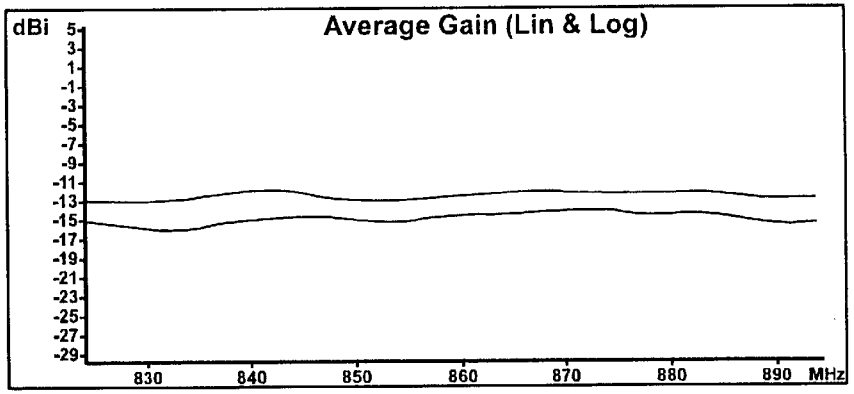
Fig. 10 (PRIOR ART)
FIG. 10 depicts the average gain of a prior art collinear antenna taken at 30 degrees with respect to the bottom of the antenna.
Figure 9:
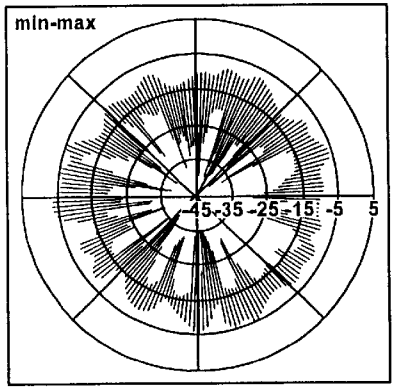
Fig. 9 (PRIOR ART)
FIG. 9 depicts the min-max horizontal directional diagram of a prior art collinear antenna taken at 30 degrees with respect to the bottom of the antenna.
Figure 12:
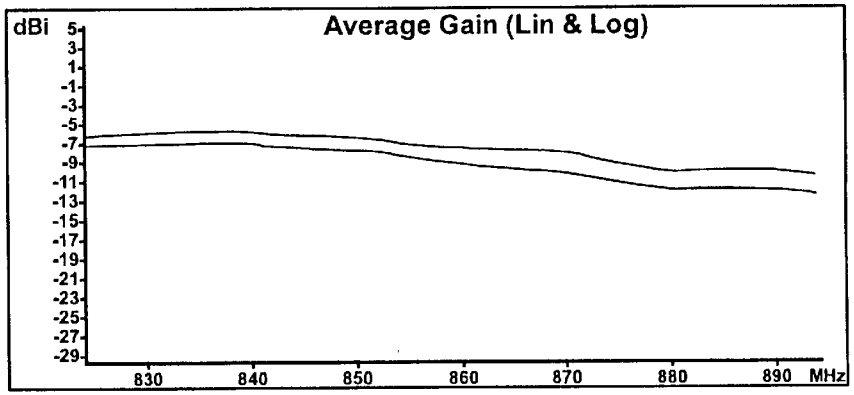
Fig. 12 (PRIOR ART)
FIG. 12 depicts the average gain of a prior art collinear antenna taken at 40 degrees with respect to the bottom of the antenna.
Figure 11:
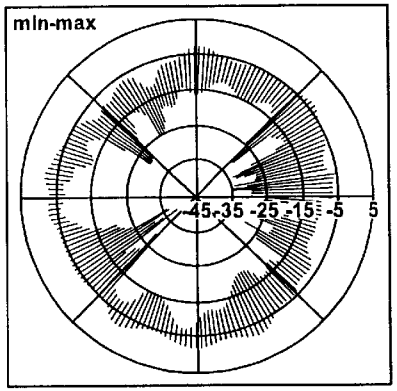
Fig. 11 (PRIOR ART)
FIG. 11 depicts the min-max horizontal directional diagram of a prior art collinear antenna taken at 40 degrees with respect to the bottom of the antenna.
Figure 14:
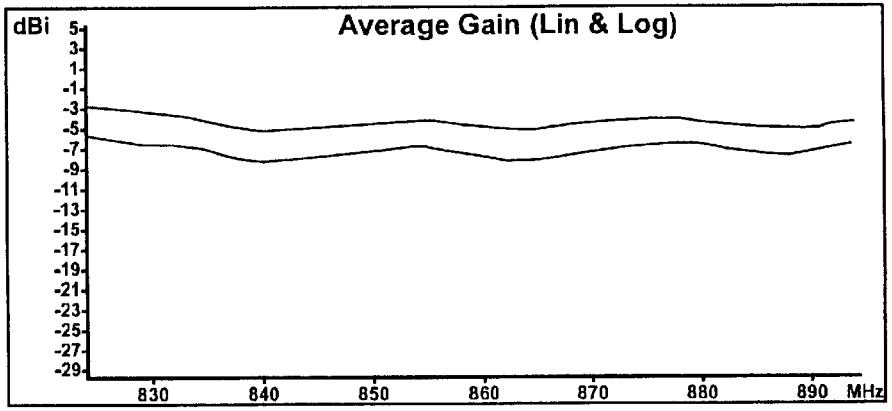
FIG. 14 depicts the average gain of a passive diversity antenna system with parallel tuned feeders of the invention taken at 0 degrees with respect to the bottom of the antenna.
Figure 16:
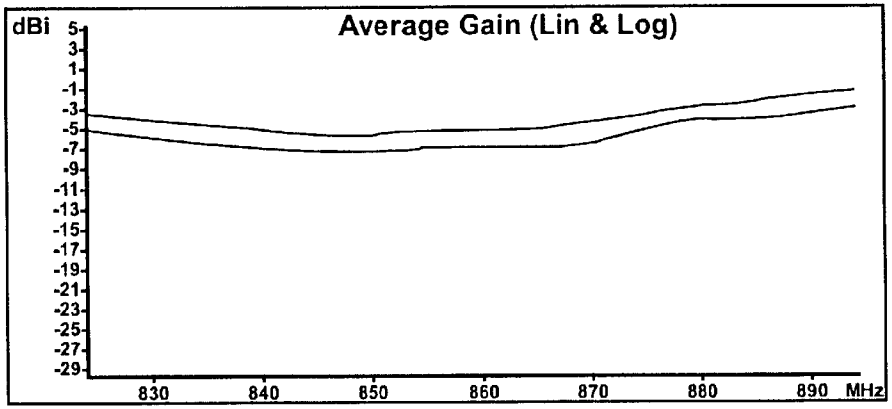
FIG. 16 depicts the average gain of a passive diversity antenna system with parallel tuned feeders of the invention taken at 20 degrees with respect to the bottom of the antenna.
Figure 13:
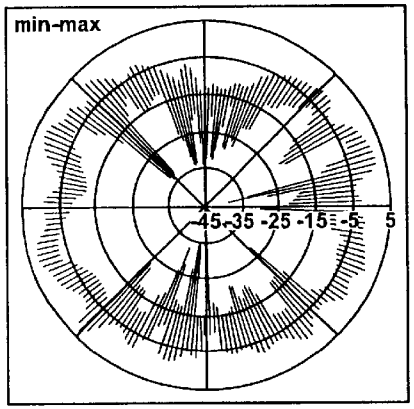
FIG. 13 depicts the min-max horizontal directional diagram of a passive diversity antenna system with parallel tuned feeders of the invention taken at 0 degrees with respect to the bottom of the antenna.
Figure 15:
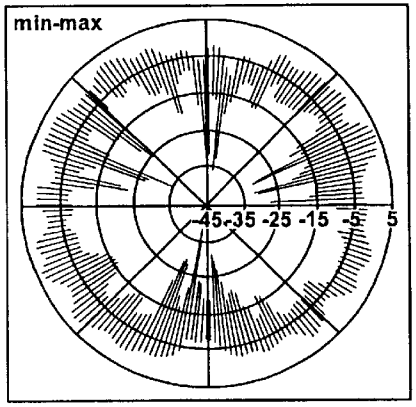
FIG. 15 depicts the min-max horizontal directional diagram of a passive diversity antenna system with parallel tuned feeders of the invention taken at 20 degrees with respect to the bottom of the antenna.
Figure 17:
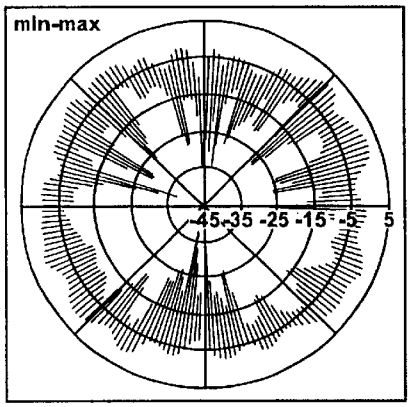
FIG. 17 depicts the min-max horizontal directional diagram of a passive diversity antenna system with parallel tuned feeders of the invention taken at 30 degrees with respect to the bottom of the antenna.
Figure 18:
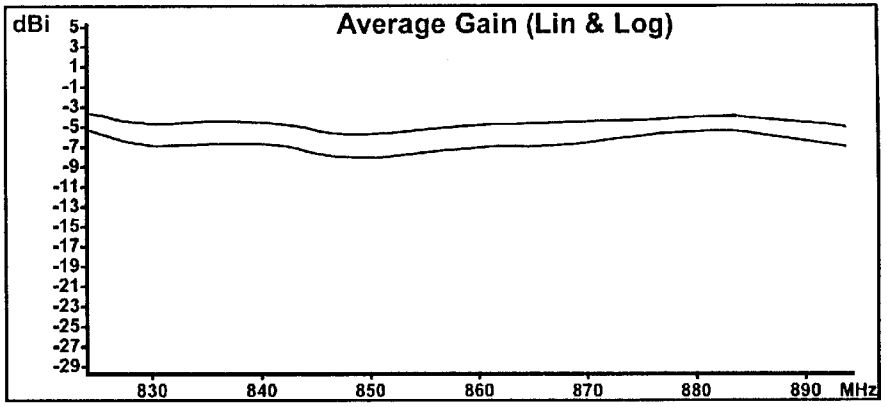
FIG. 18 depicts the average gain of a passive diversity antenna system with parallel tuned feeders of the invention taken at 30 degrees with respect to the bottom of the antenna.
Figure 19:
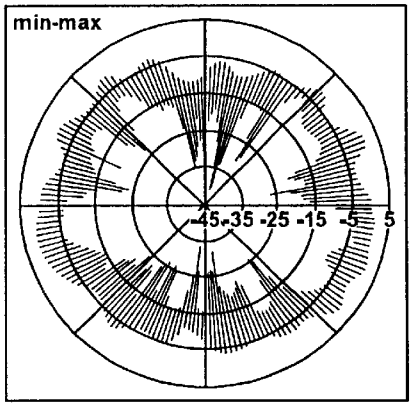
FIG. 19 depicts the min-max horizontal directional diagram of a passive diversity antenna system with parallel tuned feeders of the invention taken at 40 degrees with respect to the bottom of the antenna.
Figure 20:
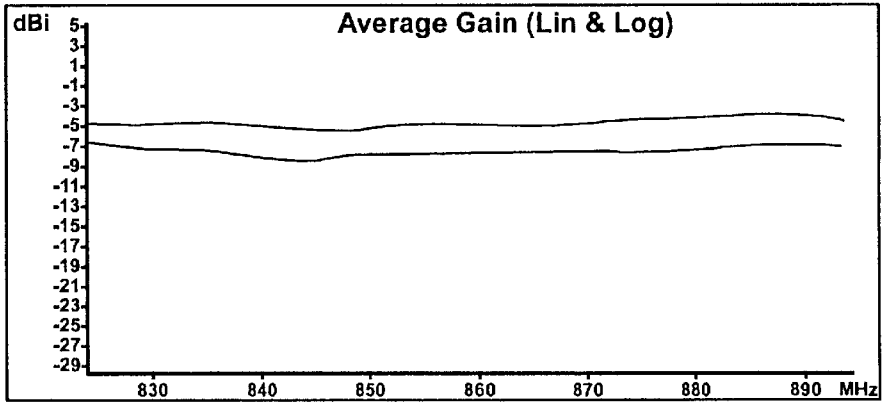
FIG. 20 depicts the average gain of a passive diversity antenna system with parallel tuned feeders of the invention taken at 40 degrees with respect to the bottom of the antenna.

As seen in FIGS. 5 and 13, the prior art collinear antenna performed better than the dipole antenna of this invention at 0 degrees. In contrast, as seen in FIGS. 11 and 19, the dipole antenna of this invention performed better than the collinear antenna of the prior art as the angle increased. It will be readily understood, for example, that the dipole antenna of this invention performs better than the collinear antenna in hilly areas because the radiated energy approaches the antenna from elevated transmitters, resulting in an increased elevation angle.

While advantageous embodiments have been chosen to illustrate the invention, it will be understood by those skilled in the art that various changes and modifications can be made therein without departing from the scope of the invention, as defined in the appended claims. For example, the parallel tuned feeder is not limited to the broadband dipole antenna, as many different types of antennas could be placed in the center area of a window while concealing the coaxial cable. Other antenna designs also using a tuned feeder could be used to steer the radiation pattern is desired. The transceiver can be any two-way communications device, including a wireless modem.

What is claimed is:

1. A glass antenna assembly comprising:

first and second dipole antenna sets formed on a first glass surface, wherein said glass is mounted on a vehicle;

a first parallel tuned feeder having a first end and a second end, said first end electrically connected to said first dipole antenna and a second parallel tuned feeder having a third end and a fourth end, said third end electrically connected to said second dipole antenna;

a first coaxial cable having a fifth end and a sixth end, said fifth end electrically connected to the first parallel tuned feeder second end and a second coaxial cable having a seventh end and an eighth end, said seventh end electrically connected to the second parallel tuned feeder fourth end;

a combiner that electrically combines the first coaxial cable sixth end and the second coaxial cable eighth end into a single coaxial output;

a third coaxial cable having a ninth end and a tenth end, said ninth end electrically connected to the single coaxial output of the combiner; and a transceiver electrically connected to the third coaxial cable tenth end for transmitting or receiving radio signals through the first and second dipole antenna sets.

2. The glass antenna assembly of claim 1, wherein said first and second dipole antenna sets each further comprise three antenna wires.

3. The glass antenna assembly of claim 1, wherein the first and second dipole antenna sets are for use in cellular telephony.

4. The glass antenna assembly of claim 1, wherein the first and second dipole antenna sets are tuned to a bandwidth of approximately 70 MHz.

5. The glass antenna assembly of claim 1, wherein the first and second parallel tuned feeders are formed on the first glass surface.

6. The glass antenna assembly of claim 1, wherein the first and second parallel tuned feeders are printed on the first glass surface.

7. The glass antenna assembly of claim 1, wherein the first and second dipole antenna sets are printed on the first glass surface.

8. The glass antenna assembly of claim 1, wherein the first coaxial cable has a first impedance, the second coaxial cable has a second impedance, the antenna assembly has an antenna impedance, and wherein said first and second parallel tuned feeders transforms the first and second impedance to match the impedance of the antenna assembly.

9. The glass antenna assembly of claim 1, wherein the first and second dipole antenna sets each have an omni-directional antenna pattern.

10. The glass antenna assembly of claim 1, further comprising a third and fourth dipole antenna sets formed on a second glass surface.

11. The glass antenna assembly of claim 10, wherein the first glass surface is on a first vehicle window and the second glass surface is on a second vehicle window.

12. The glass antenna assembly of claim 11, wherein the first vehicle window and the second vehicle window are positioned on opposite sides of the vehicle.

13. The glass antenna assembly of claim 11, wherein at least one-of the first vehicle window and the second vehicle window is a stationary window.

14. The glass antenna assembly of claim 1, wherein the first dipole antenna set is tuned to an upper part of a predetermined frequency band and the second dipole antenna set is tuned to a lower part of the predetermined frequency band.

15. The glass antenna assembly of claim 14, wherein the band width is approximately 70 MHz.

* * * * *